United States Patent [19]

Hahm et al.

[11] 4,209,143

[45] Jun. 24, 1980

[54] COIL CARRIER WITH CARRIER ELEMENTS EXTENDING PARALLEL TO ITS AXIS

[75] Inventors: Gerhard H. Hahm, Aachen; Walter Henning, Alsdorf-Begau, both of Fed. Rep. of Germany

[73] Assignee: Messrs. Jos. Zimmerman, Aachen, Fed. Rep. of Germany

[21] Appl. No.: 18,042

[22] Filed: Mar. 6, 1979

[30] Foreign Application Priority Data

Mar. 9, 1978 [DE] Fed. Rep. of Germany ..... 2810163

[51] Int. Cl.[2] ..... B65H 75/12; B65H 75/20

[52] U.S. Cl. ..... 242/118.11

[58] Field of Search ..... 242/118.11, 118.2, 118.1, 242/118.41, 118; 68/198

[56] References Cited

U.S. PATENT DOCUMENTS

| | | | |
|---|---|---|---|
| 2,936,964 | 5/1960 | Tigges | 242/118.1 |
| 3,307,803 | 3/1967 | Tigges | 242/118.11 |
| 3,826,444 | 7/1974 | Hahm | 242/118.11 |

*Primary Examiner*—George F. Mautz

*Attorney, Agent, or Firm*—Mason, Fenwick & Lawrence

[57] ABSTRACT

In a coil carrier wth only one end ring provided with radially inwardly open apertures and carrier elements extending parallel to the axis of the coil carrier, the elements are divided into two sections of which the section adjacent the end ring is formed with two limbs which converge at an acute angle to the end of this section remote from the end ring. The second section is formed by a rod element extending parallel to the axis of the coil carrier. Axially aligned such coil carriers can be telescoped one into the other.

8 Claims, 5 Drawing Figures

COIL CARRIER WITH CARRIER ELEMENTS EXTENDING PARALLEL TO ITS AXIS

The invention relates to a carrier for a winding or coil, also variously known as a package carrier, lap creel, lap roller, winding or coil former, can, spool, reel or bobbin. It is primarily intended for supporting packages of textile thread or yarn but is not restricted thereto and will herein be referred to simply as a coil carrier.

The coil carrier to which the invention is relevant has carrier elements extending parallel to its axis, the carrier elements projecting radially outwardly into a common cylindrical surface, being secured to only one apertured end ring and being divided into two sections of which the first section adjacent the end ring has two limbs.

A coil carrier of this type is shown in U.S. Pat. No. 4,078,740 wherein the limbs of the first section of the carrier elements are parallel to each other and have their respective one end secured to one side of one aperture in the end ring. The apertures are adapted to the cross-section of the second section of the carrier elements.

In this known coil carrier which has proved successful in many cases, it has sometimes been found disadvantageous that the apertures must substantially correspond to the cross-section of the second section of the carrier elements, this possibly creating difficulties when it is desired to telescope two such coil carriers. Further, with this known coil carrier it is not possible to push it into a second like coil carrier by 50% or more of its length.

It is an object of the present invention to construct a coil carrier of the aforementioned kind so that its stiffness is increased without requiring substantially more material than the known coil carrier and at the same time to simplify the telescoping of such coil carriers.

According to the invention, each limb of the first section is secured to the end ring on one side of an aperture, the two limbs of the first section converge at an acute angle up to that end of the first section which is remote from the end ring, and the second section is in the form of a rod member extending parallel to the axis. By reason of the obliquely tapering limbs of the first section one obtains a particularly stiff construction for the coil carrier. This is particularly so if, as will usually be advantageous, the axial extent of the first section is a multiple of the axial extent of the second section.

The extent to which one coil carrier can be introduced into another is for the most part a matter of choice and can amount to considerably more than 50% of the length of the coil carrier.

The invention also provides for the carrier elements to be interconnected by stiffners disposed radially within the carrier elements at least in the region of the second section. This arrangement leads to a further increase in the stiffness of the coil carrier without impeding the telescoping of two coil carriers. The stiffeners can be disposed in planes normal to the axis of the coil carrier. However, it is also possible to incline the stiffeners to these planes. Further, it is possible to locate the stiffeners so that the carrier elements of a second coil carrier lie on these stiffeners and thereby counteract buckling when several such carriers are interconnected by telescoping.

The invention also provides for a circumferential supporting ring in the region of the free ends of the second sections to have an external diameter equal to or less than the cylindrical surface containing the inner faces of the carrier elements. This supporting ring particularly ensures stability of the coil carrier in the region of those ends of the carrier elements which are remote from the end ring.

The invention also provides for a supporting ring in the region of the transition between the first and second sections of the carrier elements to have a larger diameter than that of the cylindrical surface containing the inner faces of the carrier elements. Apart from further stiffening of the coil carrier, this supporting ring serves to determine the maximum amount to which a coil carrier can be introduced in another.

Finally, the invention suggests that the circumferential extent of each aperture in the end ring be substantially equal to the maximum spacing between the limbs of each supporting element. This considerably facilitates the telescoping of two coil carriers in so far that the area of the apertures in the one coil carrier is, as viewed circumferentially, considerably larger than the corresponding dimension of the free end of the carrier element of another coil carrier. When the coil carriers are inter-telescoped further, they automatically become circumferentially aligned.

A few examples of the invention will now be described with reference to the accompanying drawings, wherein.

Figure 1:
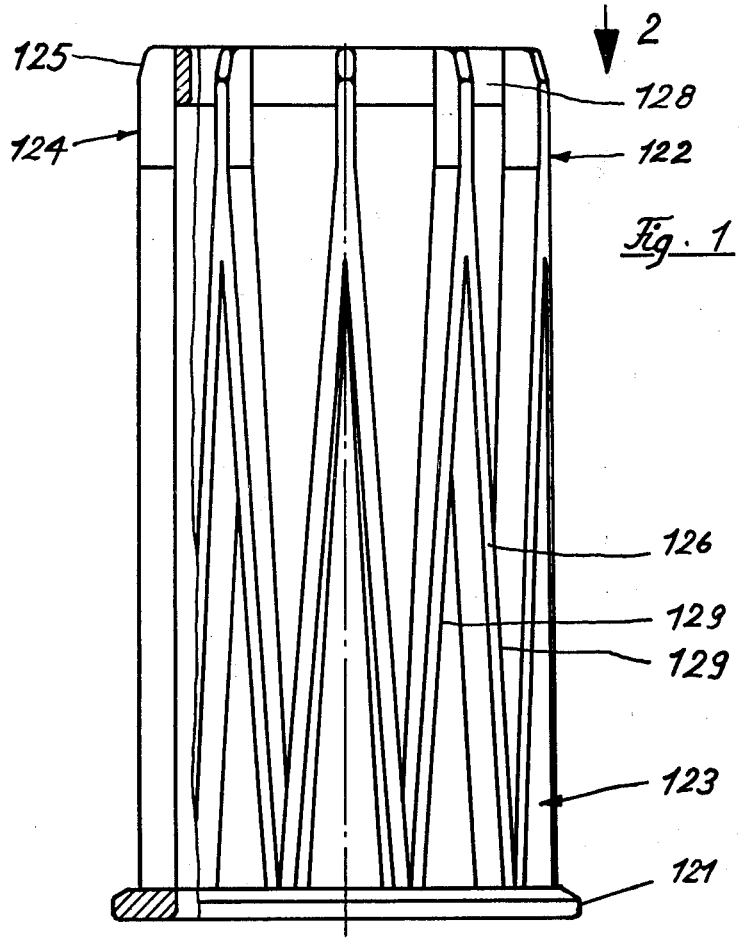
FIG. 1 is a part-sectional elevation of a first embodiment of a coil carrier according to the invention taken on the line 1—1 in FIG. 2.
Figure 2:
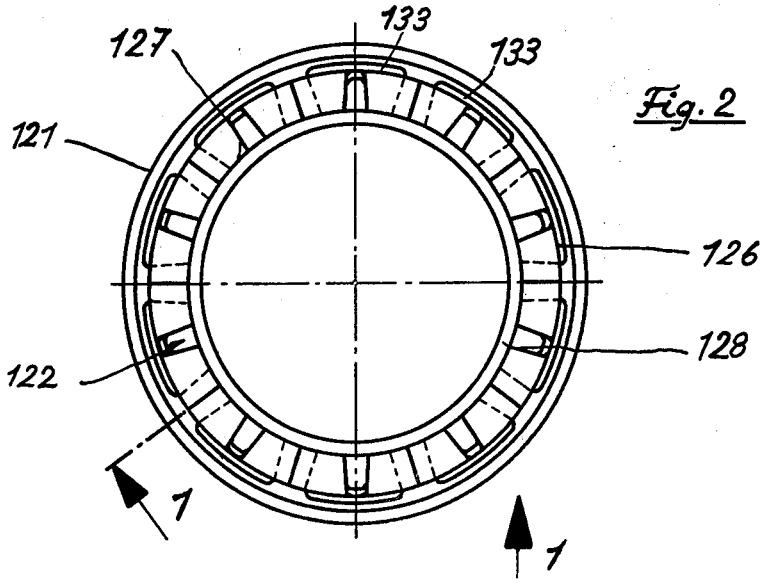
FIG. 2 is a plan view of the coil carrier taken in the direction of the arrow 2 in FIG. 1.
Figure 3:
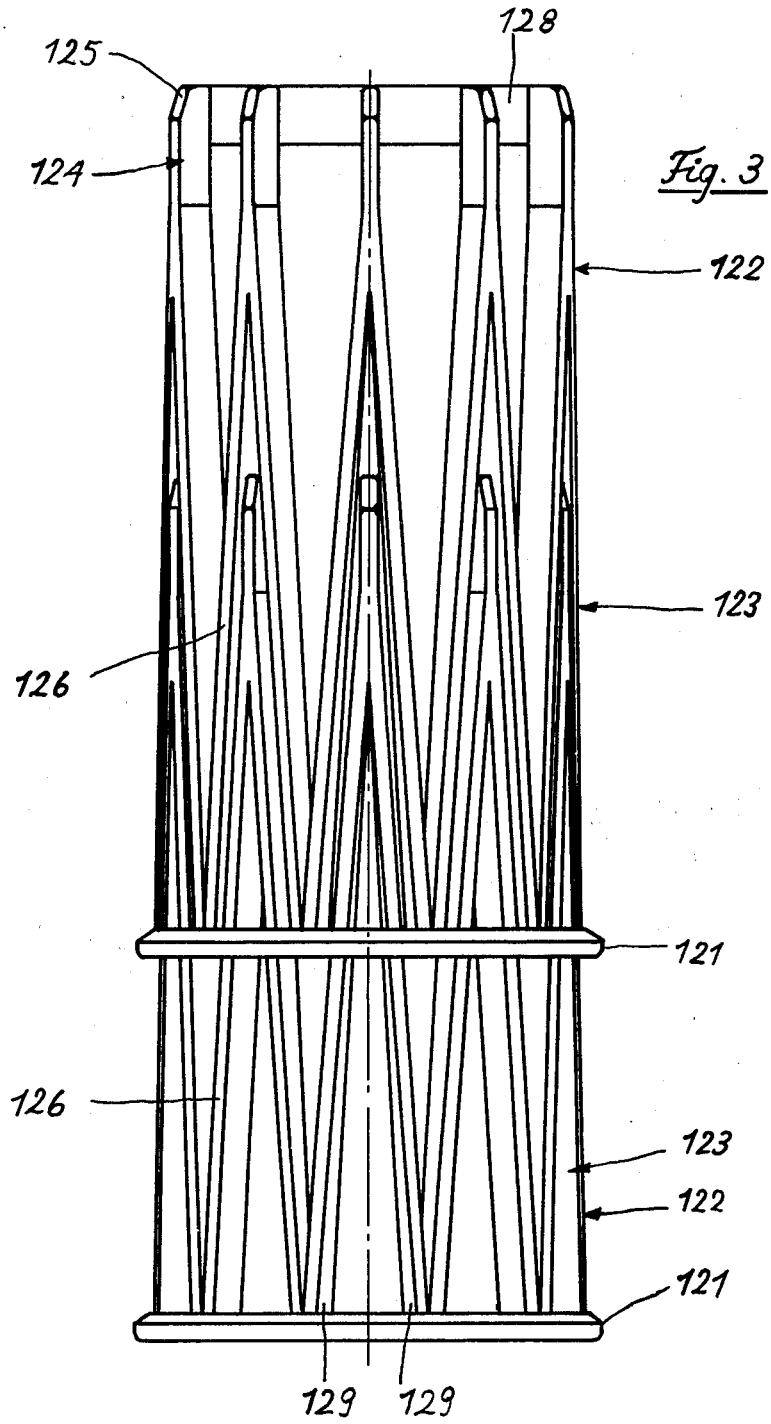
FIG. 3 is an elevation of two partially telescoped coil carriers of the FIG. 1 construction.

The embodiment of coil carrier shown in FIGS. 1 to 3 comprises an end ring 121 from which carrier elements 122 extend parallel to the axis of the coil carrier. The carrier elements are divided into a first section 123 adjacent the end ring 121 as well as an adjoining second section 124. Each carrier element 122 is constructed to be symmetrical in relation to a plane containing the axis of the coil carrier. The second sections 124 are bevelled at their free ends 125. Each carrier element 122 has a continuous outer surface 126. The outer surfaces 126 of all the carrier elements 122 lie on a common cylindrical enveloping surface. Each carrier element 122 has an inner face 127, the inner faces of all the carrier elements 122 lying on a common cylindrical surface.

The first sections 123 of the carrier elements 122 adjacent the end ring 121 each consist of two limbs 129 which are inclined to each other and converge at an acute angle towards that end of the first section 123 which is remote from the end ring 121. The second sections 124 of the carrier elements 122 are rod members which extend parallel to the axis and are interconnected at their free ends by a supporting ring 128 as is particularly evident from FIG. 2. The supporting ring 128 has an external diameter slightly less than the diameter of the cylindrical surface containing the inner faces 127 of the carrier elements 122. The axial extent of the second section 124 is in this embodiment only a small fraction of the axial extent of the entire coil carrier.

The limbs 129 are connected to the end ring 121 in a manner such that apertures 133 are formed in the end ring that correspond to the maximum circumferential spacing between the two limbs 129 of each carrier element 122. The radially outer boundary of the apertures 133 is disposed on a circle of slightly larger diameter than that of the cylindrical enveloping surface containing the outer faces 126 of the carrier elements 122.

When inter-telescoping two axially aligned coil carriers, the free ends of the second sections 124 or rod members of the carrier elements 122 are first offered to and introduced in the apertures 133. Since the circumferential dimensions of the apertures are considerably larger than the corresponding dimensions of the second sections 124, such introduction presents absolutely no problem. Upon further telescoping movement, a certain amount of alignment of the adjacent coil carriers takes place automatically in that the free ends 125 of the second sections 124 meet and ride on one of the limbs 129 which, if necessary, brings about relative rotation between the two coil carriers about their common axis.

In addition to the supporting ring 128, the FIGS. 1 to 3 embodiment may also provide for further supporting elements. It is also possible to provide the carrier elements 122 with abutments or blocking elements which positively limit the maximum extent to which one coil carrier can be introduced in another.

Figure 4:
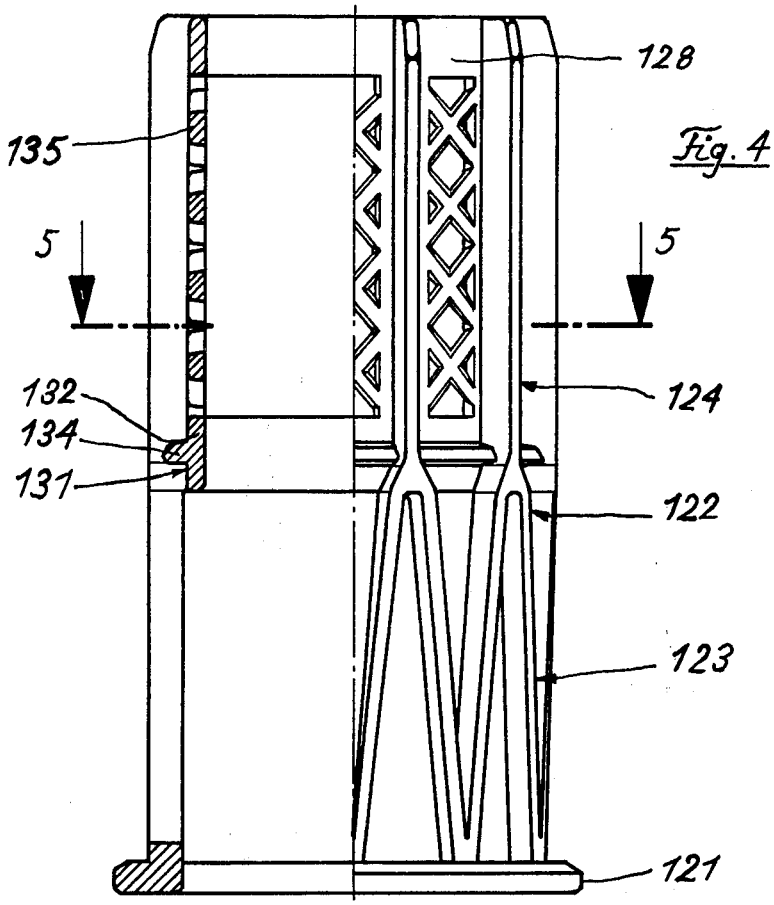
FIG. 4 is a part-sectional elevation of a second embodiment of coil carrier according to the invention taken on the line 4—4 in FIG. 5
Figure 5:
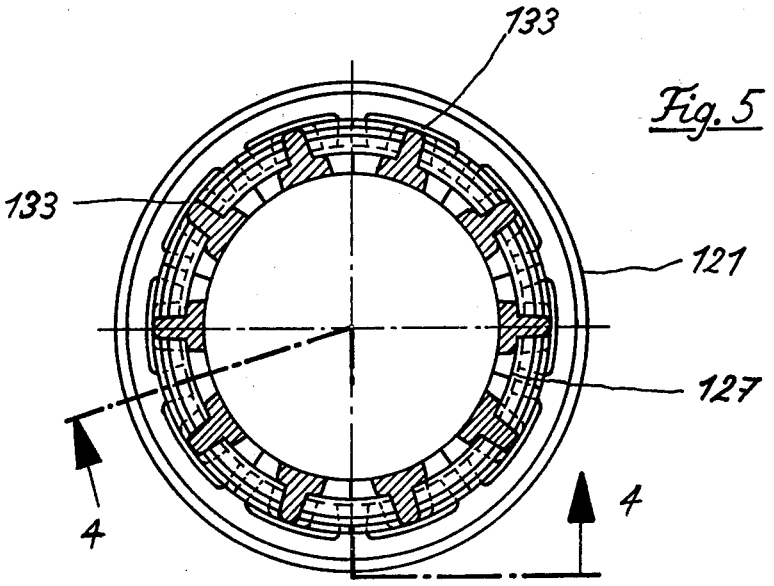
FIG. 5 is a section on the line 5—5 in FIG. 4.

The embodiment of the invention according to FIGS. 4 and 5 differs from that of FIGS. 1 to 3 substantially only in that the axial extent of the two sections of the carrier elements 122 is substantially the same. In this embodiment the end ring 121 is likewise provided with apertures 133. Further, this embodiment also comprises a supporting ring 128.

In the region of the transition between the first sections 123 of the carrier elements 122 and the second sections 124 there is a ring 131. This ring 131 has a base 132 disposed radially inwardly of the carrier elements 122. A ring attachment 134 connected to this base 132 has an external diameter larger than the diameter of the cylindrical surface containing the inner faces 127 of the carrier elements 122. The ring attachment 134 ensures that the maximum amount by which one coil carrier can be introduced in another is positively limited.

Stiffeners 135 provided between the supporting ring 128 and the ring attachment 134 have an external diameter slightly less than the enveloping surface containing the inner faces 127 of the carrier elements 122. The stiffeners 135 in the FIG. 4 embodiment are so disposed between two carrier elements that they are inclined to a plane normal to the axis of the coil carrier. Two respectively oppositely inclined stiffeners 135 intersect. The arrangement of the stiffeners 135 can to a large extent be selected at will. In one possible arrangement of these stiffeners, they lie in planes normal to the axis of the coil carrier.

The embodiments of coil carriers here described are desirably produced from plastics material but can also be made from any other suitable material.

We claim:

1. A stackable coil carrier of generally cylindrical configuration comprising carrier elements which extend parallel to the axis of the carrier and have an outer extent defined by a cylindrical surface, an apertured end ring having a plurality of apertures, said carrier elements including first and second sections of which said first section has two limbs each having two ends with one end of each limb being secured to the apertured end ring adjacent one side of an aperture thereof, said two limbs of said first section at their ends remote from the apertured end ring converging with each other at an acute angle to define the juncture of the first and second sections and wherein said second section comprises rod members extending parallel to the axis of the carrier and having free outer ends.

2. The coil carrier of claim 1 additionally including stiffener members disposed radially within and connected to the rod members of the second section.

3. The coil carrier of claim 2 additionally including a circumferential supporting ring in the region of the free outer ends of the rod members of said supporting ring having an external diameter equal to or less than the diameter of a cylindrical surface containing the radial inner extent of the carrier elements.

4. The coil carrier of claim 3 additionally including a ring attached to the carrier elements in the region of the juncture of the first and second sections of the carrier elements, said ring having a larger outer diameter than that of the cylindrical surface containing the radial inner extent of the carrier elements.

5. The coil carrier of claim 1 wherein the circumferential extent of each aperture in the apertured end ring is substantially equal to the maximum spacing between the limbs of each respective carrier element.

6. The coil carrier of claim 5 additionally including a circumferential supporting ring in the region of the free outer ends of the rod members of the said supporting ring having an external diameter equal to or less than the diameter of a cylindrical surface containing the radial inner extent of the carrier elements.

7. The coil carrier of claim 1 additionally including a circumferential supporting ring in the region of the free outer ends of the rod members of the said supporting ring having an external diameter equal to or less than the diameter of a cylindrical surface containing the radial inner extent of the carrier elements.

8. The coil carrier of claim 7 additionally including a ring attached to the carrier elements in the region of the juncture of the first and second sections of the carrier elements, said inner ring having a larger outer diameter than that of the cylindrical surface containing the radial inner extent of the carrier elements.

* * * * *